US011242672B2

(12) United States Patent
Hyodo et al.

(10) Patent No.: US 11,242,672 B2
(45) Date of Patent: Feb. 8, 2022

(54) WHEEL LOADER

(71) Applicant: Hitachi Construction Machinery Co., Ltd., Tokyo (JP)

(72) Inventors: Koji Hyodo, Ibaraki (JP); Isamu Aoki, Ibaraki (JP); Tetsuji Tanaka, Chiba (JP); Koji Shimazaki, Hyogo (JP); Hironao Suzuki, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 487 days.

(21) Appl. No.: 16/328,857

(22) PCT Filed: Sep. 29, 2017

(86) PCT No.: PCT/JP2017/035592
§ 371 (c)(1),
(2) Date: Feb. 27, 2019

(87) PCT Pub. No.: WO2019/064527
PCT Pub. Date: Apr. 4, 2019

(65) Prior Publication Data

US 2021/0355657 A1 Nov. 18, 2021

(51) Int. Cl.
*E02F 9/22* (2006.01)
*E02F 9/20* (2006.01)

(52) U.S. Cl.
CPC ..... *E02F 9/2253* (2013.01); *E02F 9/202* (2013.01)

(58) Field of Classification Search
CPC ..... E02F 9/2253; E02F 9/202
See application file for complete search history.

(56) References Cited

U.S. PATENT DOCUMENTS 7,877,183 B2 * 1/2011 Hoff ..... F02D 31/009 701/51
8,777,808 B2 * 7/2014 Hyodo ..... E02F 9/20 477/54

(Continued)

FOREIGN PATENT DOCUMENTS

CN 106523445 A 3/2017
EP 2 716 939 A1 4/2014

(Continued)

*Primary Examiner* — Tyler J Lee
(74) *Attorney, Agent, or Firm* — Crowell & Moring LLP

(57) ABSTRACT

A wheel loader configured to reduce a sudden change in vehicle speed caused by an erroneous determination of a raising operation of a lift arm is provided. A wheel loader 1 includes an engine 3, a variable displacement type HST pump 41, a variable displacement type HST motor 42 coupled to the HST pump 41 in a closed circuit, a hydraulic pump for working device 43, a forward/reverse selector switch 62 for switching a forward movement and a backward movement of a vehicle body, a depression amount sensor 610 that detects a depression amount of an accelerator pedal 61, a pressure sensor 73 that detects a discharge pressure Pa of the hydraulic pump for working device 43, and a controller 5. The controller 5 determines whether a specific condition to identify an upward movement of a lift arm 21 during a forward travel of the vehicle body based on a forward/reverse switching signal, the depression amount of the accelerator pedal 61, and the discharge pressure Pa detected by the pressure sensor 73. When the specific condition is satisfied, the controller 5 controls a displacement volume of the HST motor 42 according to an increase of the discharge pressure Pa, so as to limit the vehicle speed.

8 Claims, 14 Drawing Sheets

(56) References Cited

U.S. PATENT DOCUMENTS

| | | | | |
|---|---|---|---|---|
| 9,328,478 | B2 * | 5/2016 | Filla | E02F 9/2246 |
| 2004/0117092 | A1 * | 6/2004 | Budde | E02F 3/432 701/50 |
| 2010/0262353 | A1 * | 10/2010 | Hyodo | B60W 10/06 701/102 |
| 2011/0196585 | A1 | 8/2011 | Ishibashi et al. | |
| 2012/0100959 | A1 * | 4/2012 | Hyodo | E02F 9/2246 477/111 |
| 2016/0326720 | A1 | 11/2016 | Uno et al. | |
| 2018/0080193 | A1 * | 3/2018 | Myers | E02F 9/2079 |

FOREIGN PATENT DOCUMENTS

| | | | |
|---|---|---|---|
| EP | 2 792 873 | A1 | 10/2014 |
| GB | 2 395 768 | A | 6/2004 |
| JP | 2010-25179 | A | 2/2010 |
| JP | 2015-94070 | A | 5/2015 |
| WO | WO 2009/019974 | A1 | 2/2009 |
| WO | WO 2013/145342 | A1 | 10/2013 |
| WO | WO 2015/098545 | A1 | 7/2015 |

* cited by examiner

WHEEL LOADER

TECHNICAL FIELD

The present invention relates to a wheel loader that includes a continuously variable travel drive system.

BACKGROUND ART

As the continuously variable travel drive system, for example, there has been known an HST type or an HMT type where a hydraulic pump is driven by an engine to generate a hydraulic pressure and the hydraulic pressure is converted into a rotation force by a hydraulic motor, and an EMT type where an electric generator is driven by an engine to generate an electric power and the electric power is converted into a rotation force by an electric motor.

For example, Patent Literature 1 discloses a wheel loader that includes a working device, a hydraulic pressure closed circuit, and a working mechanism pump. The working device includes a lift arm turnable in a vertical direction. The hydraulic pressure closed circuit includes a variable displacement type HST pump driven by an engine and an HST motor driven by a pressure oil discharged from the HST pump. The working mechanism pump is driven by the engine to discharge a pressure oil for operating the working device.

In this wheel loader, any working mode is selectable between a power mode capable of a heavy excavation and an eco mode where an engine rotational speed is decreased to reduce fuel consumption compared with the power mode. In the case where the eco mode is selected as the working mode, when a raising movement of the lift arm is detected by detecting a bottom pressure of a lift arm cylinder, the travel drive system increases the engine rotational speed compared with the case of the eco mode. This causes the lift arm to have a speed of the raising movement less likely to be decreased even in the movement in the eco mode, thus enhancing work efficiency of the wheel loader.

CITATION LIST

Patent Literature

PATENT LITERATURE 1: Japanese Unexamined Patent Application Publication No. 2015-94070

SUMMARY OF INVENTION

Technical Problem

However, in the wheel loader disclosed in Patent Literature 1, presence/absence of the raising movement of the lift arm is determined using the bottom pressure of the lift arm cylinder. Then, for example, the bottom pressure of the lift arm cylinder increases when a load exists in a bucket even when the raising operation of the lift arm is not performed (a state where an operating lever is neutral). This possibly causes an erroneous determination that the lift arm is during the raising operation. Additionally, when the wheel loader travels on an uneven road surface of a strip mine and the like, occurrence of vibrations on a vehicle body causes the bottom pressure of the lift arm cylinder to easily vary. Then, also in this case, the erroneous determination is easily made that the lift arm is during the raising operation.

Thus, even when it is not the case where an operator intentionally performs the raising operation of the lift arm, the erroneous determination of the raising operation of the lift arm causes the engine rotational speed to be increased to sharply vary the vehicle speed, thus possibly further giving the vibration and an impact to the vehicle body and the operator.

Therefore, it is an object of the present invention to provide a wheel loader configured to reduce a sudden change in vehicle speed caused by an erroneous determination of a raising operation of a lift arm.

Solution to Problem

In order to achieve the above-described object, the present invention is a wheel loader that includes a front working device. The front working device includes a lift arm disposed on a front portion of a vehicle body. The lift arm is turnable in a vertical direction. The wheel loader includes an engine, a variable displacement type travel hydraulic pump, a variable displacement type travel hydraulic motor, a hydraulic pump for working device, a travel state sensor, a pressure sensor, and a controller. The variable displacement type travel hydraulic pump is driven by the engine. The variable displacement type travel hydraulic motor is coupled to the travel hydraulic pump in a closed circuit. The travel hydraulic motor transmits a driving force of the engine to a wheel. The hydraulic pump for working device is driven by the engine. The hydraulic pump for working device supplies a hydraulic oil to the front working device. The travel state sensor detects a travel state of the vehicle body. The pressure sensor detects a discharge pressure of the hydraulic pump for working device. The controller controls the travel hydraulic pump and the travel hydraulic motor. The controller determines whether a specific condition is satisfied based on the travel state detected by the travel state sensor and the discharge pressure detected by the pressure sensor. The specific condition is a condition to identify an upward movement of the lift arm during a forward travel of the vehicle body. The controller controls a displacement volume of the travel hydraulic pump or a displacement volume of the travel hydraulic motor according to an increase of the discharge pressure of the hydraulic pump for working device or an increase of an input torque of the hydraulic pump for working device when the specific condition is satisfied, so as to limit a vehicle speed.

Advantageous Effects of Invention

The present invention can reduce the sudden change in the vehicle speed caused by the erroneous determination of the raising operation of the lift arm. Problems, configurations, and effects other than ones described above will be made apparent from the following description of embodiments.

DESCRIPTION OF EMBODIMENTS

A description will be given of an overall configuration and movements of a wheel loader according to each embodiment of the present invention with reference to FIGS. 1 to 3.

Figure 1:
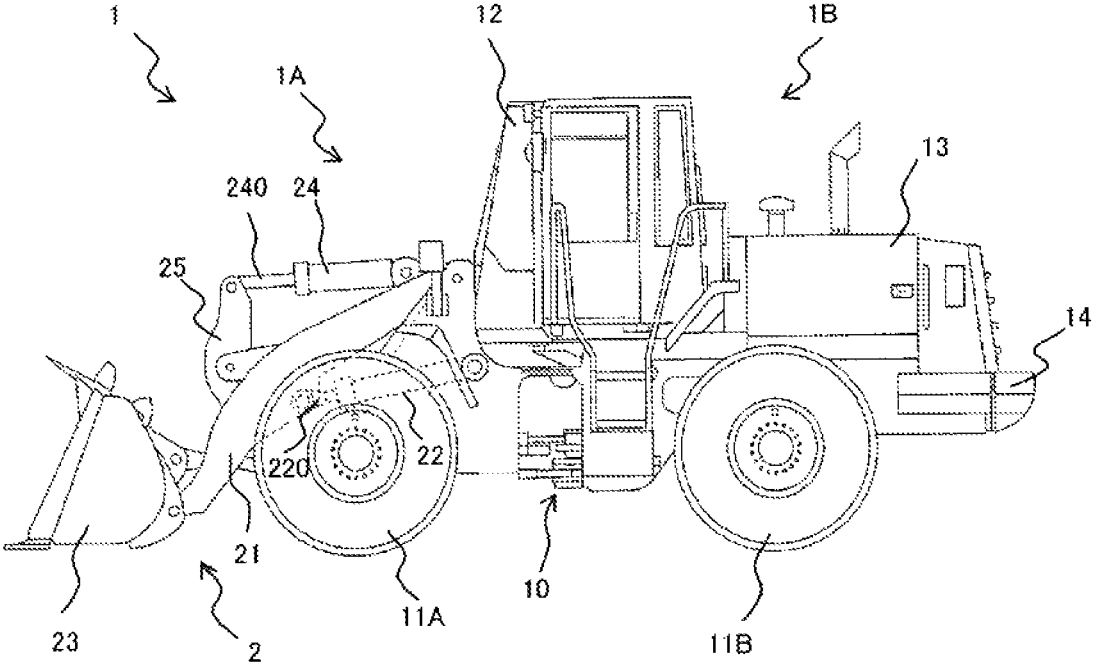
FIG. 1 is a side view illustrating an appearance of a wheel loader according to each embodiment of the present invention.

FIG. 1 is a side view illustrating an appearance of a wheel loader 1 according to each embodiment of the present invention.

The wheel loader 1 includes a vehicle body that includes a front frame 1A and a rear frame 1B, and a front working device 2 disposed on a front portion of the vehicle body. The wheel loader 1 is an articulate type working machine steered by folding the vehicle body near the center. The front frame 1A and the rear frame 1B are coupled to one another turnably in a right-left direction via a center joint 10, and the front frame 1A bends in the right-left direction with respect to the rear frame 1B.

The front frame 1A includes a pair of right and left front wheels 11A and a front working device 2. The rear frame 1B includes a pair of right and left rear wheels 11B, a cab 12 in which an operator gets, a machine room 13 that houses devices such as an engine, a controller, a cooler, and a counter weight 14 for balancing the vehicle body to prevent from falling. Note that, FIG. 1 illustrates only a left side front wheel 11A and a left side rear wheel 11B among the pair of right and left front wheels 11A and the pair of right and left rear wheels 11B.

The front working device 2 includes a lift arm 21, a pair of lift arm cylinders 22, a bucket 23, a bucket cylinder 24, a bell crank 25, and a plurality of pipes (not illustrated). The lift arm 21 is turnable in a vertical direction. The pair of lift arm cylinders 22 extend and contract to drive the lift arm 21. The bucket 23 is mounted to a distal end part of the lift arm 21. The bucket cylinder 24 extends and contracts to turn the bucket 23 in the vertical direction with respect to the lift arm 21. The bell crank 25 is turnably coupled to the lift arm 21 to constitute a link mechanism of the bucket 23 and the bucket cylinder 24. The plurality of pipes guide a pressure oil to the pair of lift arm cylinders 22 and the bucket cylinder 24. FIG. 1 illustrates only the lift arm cylinder 22 disposed on a left side with a dashed line among the pair of lift arm cylinders 22.

The lift arm 21 upwardly turns with the extension of respective rods 220 of the lift arm cylinders 22, and downwardly turns with the contraction of the respective rods 220. The bucket 23 upwardly turns (tilts) with respect to the lift arm 21 with the extension of a rod 240 of the bucket cylinder 24, and downwardly turns (dumps) with respect to the lift arm 21 with the contraction of the rod 240.

This wheel loader 1 is a working machine for, for example, a cargo work to excavate earth and sand, minerals, and the like to load onto a dump truck and the like at a strip mine and the like. Next, a description will be given of a V-shape loading as one of the methods of the excavation work and the loading work by the wheel loader 1 with reference to FIG. 2 and FIG. 3.

Figure 2:
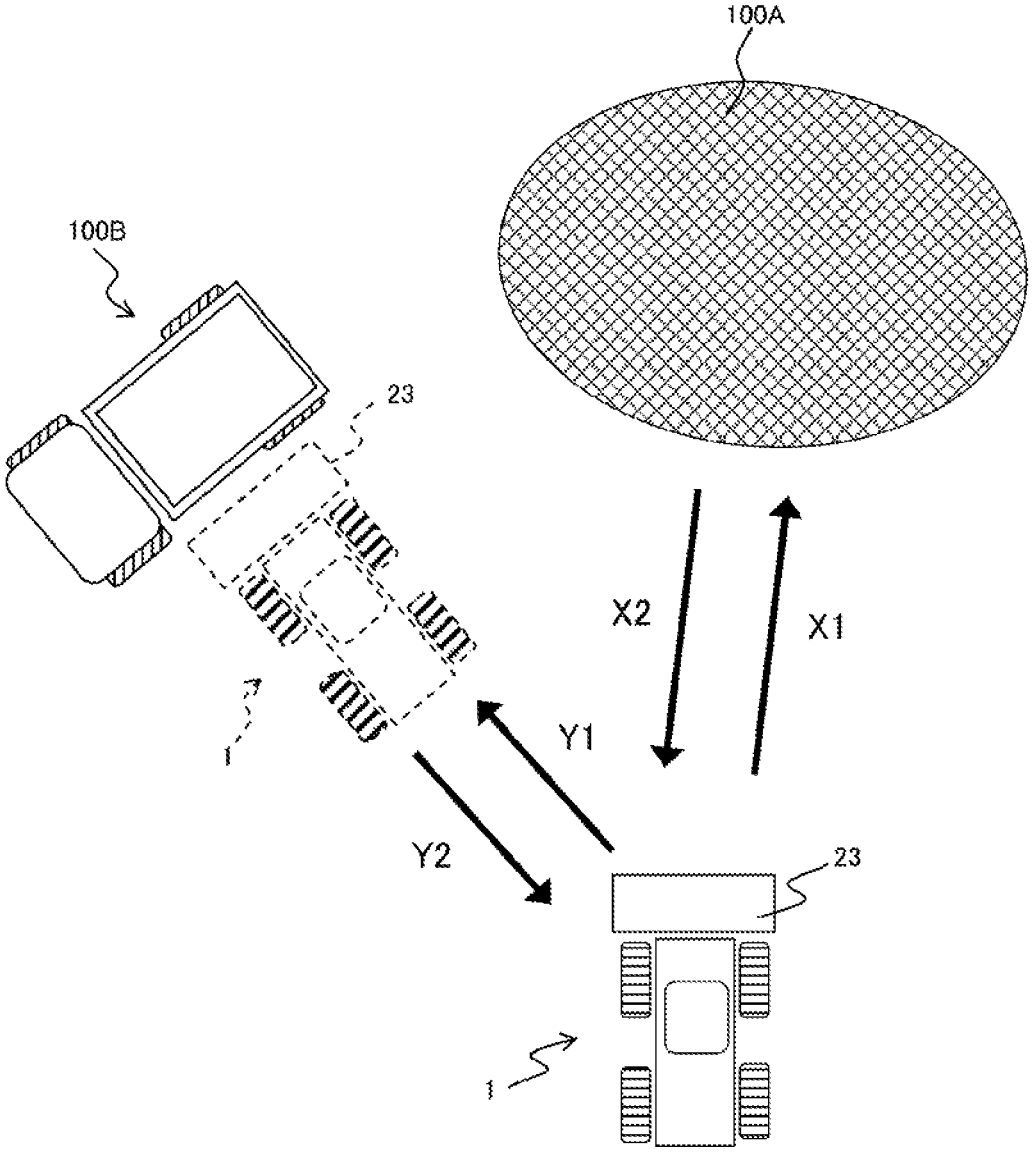
FIG. 2 is an explanatory drawing describing a V-shape loading by the wheel loader.

FIG. 2 is an explanatory drawing describing the V-shape loading by the wheel loader 1. FIG. 3 is an explanatory drawing describing a rise/run operation of the wheel loader 1.

First, the wheel loader 1 moves forward toward a natural ground 100A as an excavation target as indicated by an arrow X1, and puts the bucket 23 into the natural ground 100A to perform the excavation work. When the excavation work is finished, the wheel loader 1 once retreats to an original position as indicated by an arrow X2.

Next, the wheel loader 1 moves forward toward a dump truck 100B as indicated by an arrow Y1, and stops at a near side of the dump truck 100B. FIG. 2 illustrates the wheel loader 1 in the state of being stopped at the near side of the dump truck 100B by dashed lines.

Figure 3:
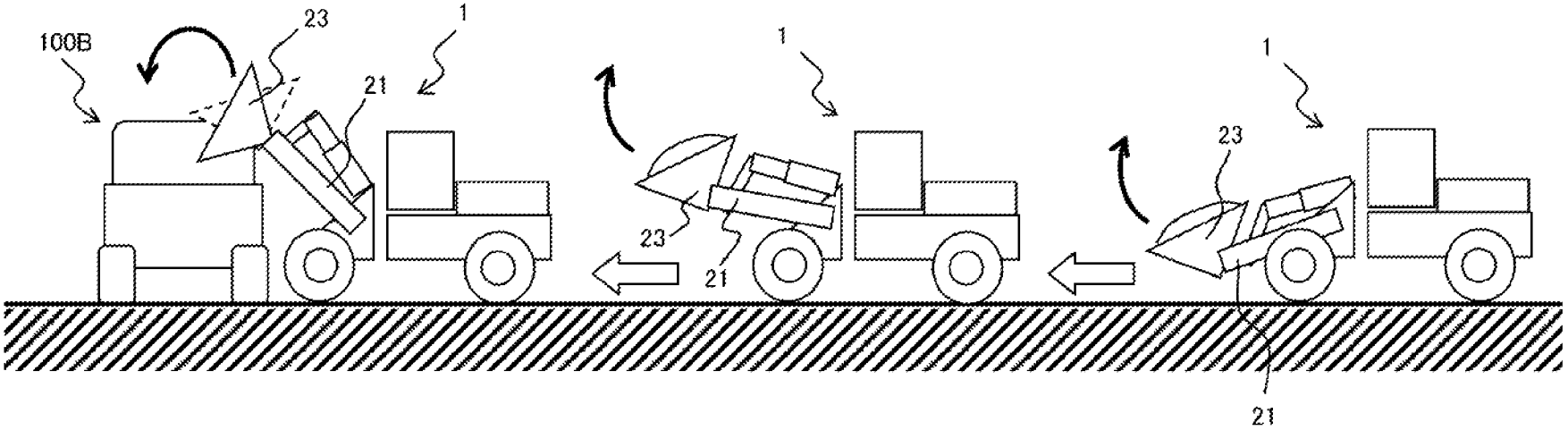
FIG. 3 is an explanatory drawing describing a rise/run operation of the wheel loader.

Specifically, as illustrated in FIG. 3, the operator fully depresses an accelerator pedal (full acceleration) while performing a raising operation of the lift arm 21 (a state illustrated on the right side in FIG. 3). Next, while the full acceleration state is kept, the lift arm 21 is further raised in the upper direction (a state illustrated in the center in FIG. 3). Then, the operator operates the brake to stop the wheel loader 1 at the near side of the dump truck 100B, and rolls the bucket 23 out to load a cargo (earth and sand, minerals, and the like) in the bucket 23 onto the dump truck 100B. This series of operations illustrated in FIG. 3 is referred to as the "rise/run operation."

When the loading work is finished, the wheel loader 1 retreats to the original position as indicated by an arrow Y2 in FIG. 2. Thus, the wheel loader 1 travels back and forth in a V shape between the natural ground 100A and the dump truck 100B to perform the excavation work and the loading work.

Next, a drive system of the wheel loader 1 will be described for each embodiment.

First Embodiment

A description will be given of the drive system of the wheel loader 1 according to the first embodiment of the present invention with reference to FIGS. 4 to 13.

(Travel Drive System)

First, the travel drive system of the wheel loader 1 will be described with reference to FIGS. 4 to 7.

Figure 4:
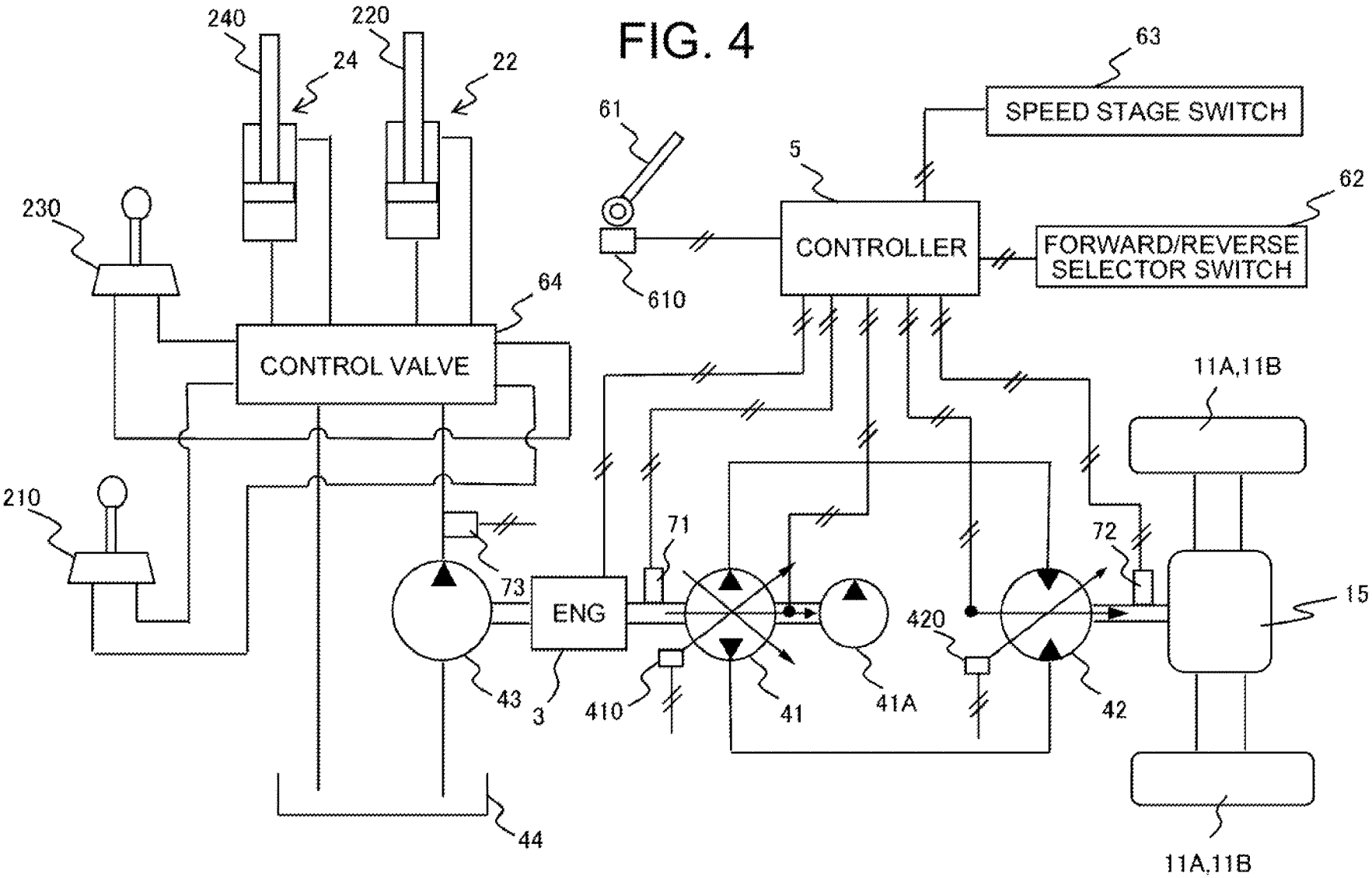
FIG. 4 is a drawing illustrating a hydraulic circuit and an electric circuit of the wheel loader according to a first embodiment.
Figure 5:
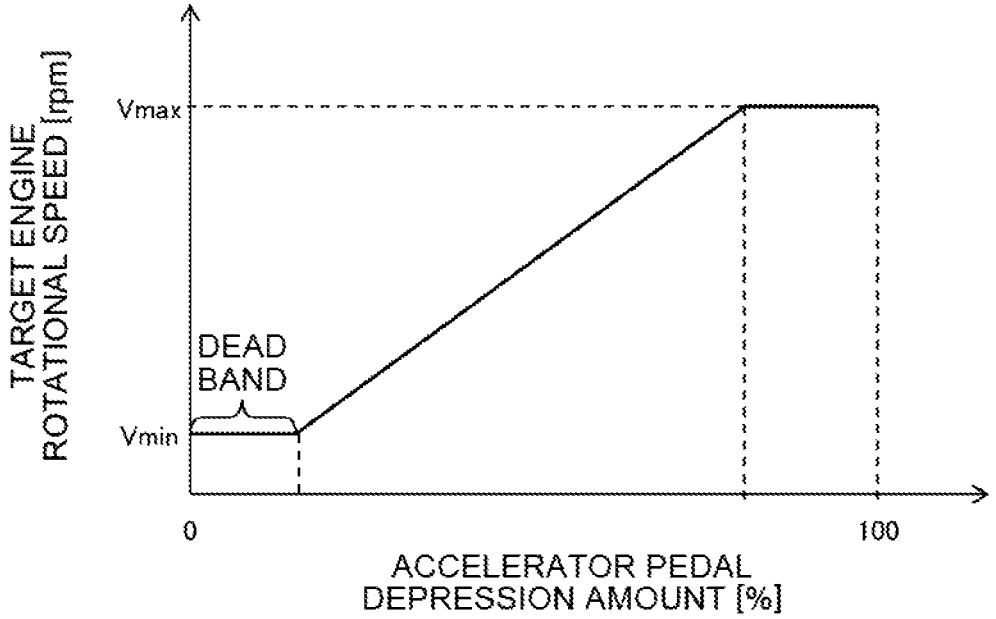
FIG. 5 is a graph illustrating a relation between an accelerator pedal depression amount and a target engine rotational speed.
Figure 6A:
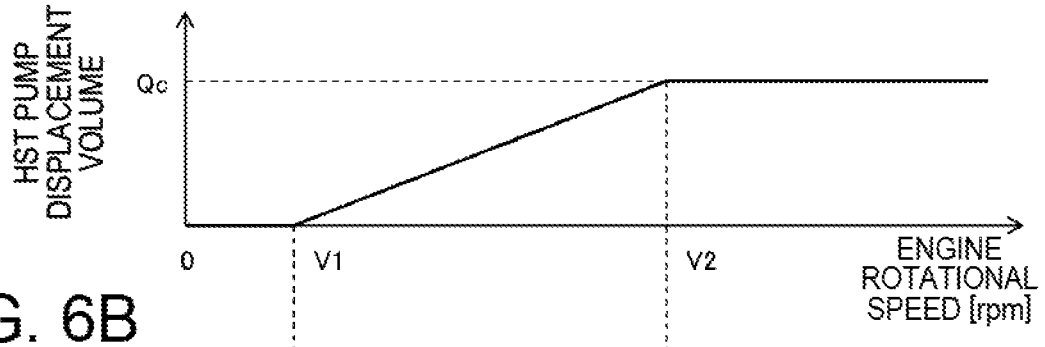
FIG. 6(*a*) is a graph illustrating a relation between an engine rotational speed and a displacement volume of an HST pump, FIG. 6(*b*) is a graph illustrating a relation between the engine rotational speed and an input torque of the HST pump, and FIG. 6(*c*) is a graph illustrating a relation between the engine rotational speed and a discharge flow rate of the HST pump.
Figure 6B:
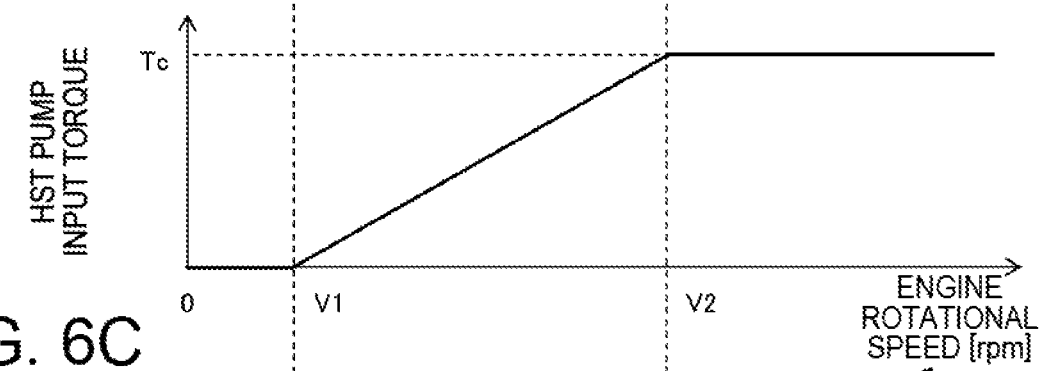
Figure 6C:
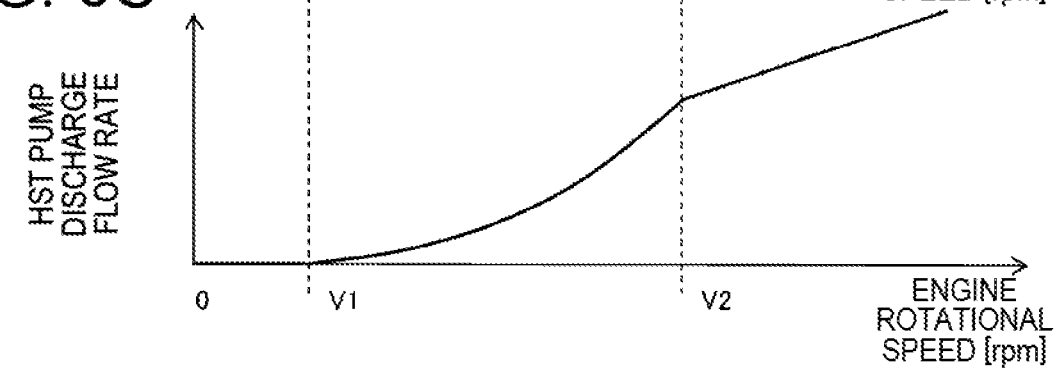
Figure 7:
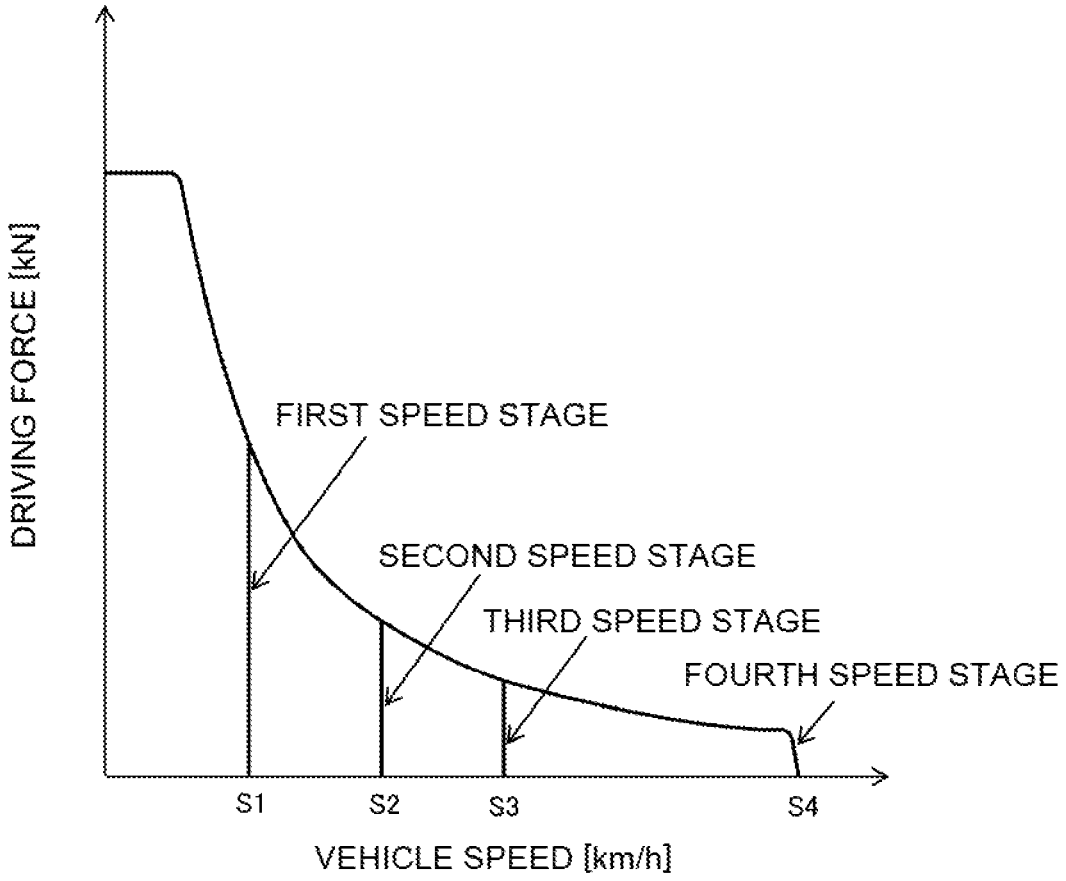
FIG. 7 is a graph illustrating a relation between a vehicle speed and a driving force for each speed stage.

FIG. 4 is a drawing illustrating a hydraulic circuit and an electric circuit of the wheel loader 1 according to the embodiment. FIG. 5 is a graph illustrating a relation between an accelerator pedal depression amount and a target engine rotational speed. FIG. 6(*a*) is a graph illustrating a relation between a rotational speed of an engine 3 and a displacement volume of an HST pump 41. FIG. 6(*b*) is a graph illustrating a relation between the rotational speed of the engine 3 and an input torque of the HST pump 41. FIG. 6(*c*) is a graph illustrating a relation between the rotational speed of the engine 3 and a discharge flow rate of the HST pump 41. FIG. 7 is a graph illustrating a relation between a maximum vehicle speed and a driving force for each speed stage.

In the wheel loader 1 according to the embodiment, the travel of the vehicle body is controlled by an HST travel drive system. As illustrated in FIG. 4, the wheel loader 1 includes the engine 3, the HST pump 41, an HST charge pump 41A, an HST motor 42, and a controller 5. The HST pump 41 is a travel hydraulic pump driven by the engine 3. The HST charge pump 41A replenishes the pressure oil for controlling the HST pump 41. The HST motor 42 is a travel hydraulic motor coupled to the HST pump 41 in a closed circuit. The controller 5 controls each device such as the HST pump 41 and the HST motor 42.

The HST pump 41 is a variable displacement type hydraulic pump of a swash-plate type or an inclined-shaft type. The HST pump 41 has a displacement volume controlled corresponding to a tilt angle. The tilt angle is adjusted by a pump regulator 410 according to a command signal output from the controller 5.

The HST motor 42 is a variable displacement type hydraulic motor of the swash-plate type or the inclined-shaft type, and the HST motor 42 has the displacement volume controlled corresponding to the tilt angle. The HST motor 42 transmits the driving force of the engine 3 to the wheels (front wheels 11A and rear wheels 11B). The tilt angle is adjusted by a motor regulator 420 according to a command signal output from the controller 5, similarly to the case of the HST pump 41.

In the HST travel drive system, first, the operator depresses an accelerator pedal 61 disposed in the cab 12 to rotate the engine 3, and then, the driving force of the engine 3 drives the HST pump 41. Then, the pressure oil discharged from the HST pump 41 rotates the HST motor 42, and an output torque from the HST motor 42 is transmitted to the front wheels 11A and the rear wheels 11B via an axle 15, and thus the wheel loader 1 travels.

Specifically, a depression amount of the accelerator pedal 61 detected by a depression amount sensor 610 is input to the controller 5, and the target engine rotational speed is output from the controller 5 to the engine 3 as the command signal. The engine 3 has the rotational speed controlled in accordance with this target engine rotational speed. As illustrated in FIG. 4, the rotational speed of the engine 3 is detected by an engine rotational speed sensor 71 disposed on an output shaft of the engine 3.

As illustrated in FIG. 5, the depression amount of the accelerator pedal 61 is proportional to the target engine rotational speed; thus, the target engine rotational speed increases as the depression amount of the accelerator pedal 61 increases. In FIG. 5, in a range of 0% to 20 or 30% in the depression amount of the accelerator pedal 61, the target engine rotational speed is constant at a minimum target engine rotational speed Vmin regardless of the depression amount of the accelerator pedal 61 (dead band). The range of this dead band is configured to be conveniently changed.

Next, the relationship between the engine 3 and the HST pump 41 is as illustrated in FIGS. 6(*a*) to 6(*c*).

As illustrated in FIG. 6(*a*), the displacement volume of the HST pump 41 is proportional to the rotational speed of the engine 3 from V1 to V2 of the engine rotational speed. The displacement volume increases from 0 to a predetermined value Qc as the rotational speed of the engine 3 increases from V1 to V2 (V1<V2). At the engine rotational speed of V2 or more, the displacement volume of the HST pump 41 is constant at the predetermined value Qc regardless of the engine rotational speed.

The input torque of the HST pump 41 is a product of the displacement volume by a discharge pressure (input torque=displacement volume×discharge pressure). As illustrated in FIG. 6(*b*), the input torque of the HST pump 41 is proportional to the rotational speed of the engine 3 from V1 to V2 of the engine rotational speed. The input torque increases from 0 to a predetermined value Tc as the rotational speed of the engine 3 increases from V1 to V2. At the engine rotational speed of V2 or more, the input torque of the HST pump 41 is constant at the predetermined value Tc regardless of the engine rotational speed.

As illustrated in FIG. 6(*c*), the discharge flow rate of the HST pump 41 is proportional to the square of the rotational speed of the engine 3 from V1 to V2 of the engine rotational speed. At the engine rotational speed of V2 or more, the discharge flow rate of the HST pump 41 is linearly proportional to the rotational speed of the engine 3, and the discharge flow rate increases as the rotational speed of the engine 3 increases.

Accordingly, the discharge flow rate of the HST pump 41 increases with the increase in the rotational speed of the engine 3; thus, the flow rate of the pressure oil flowing into the HST motor 42 from the HST pump 41 increases. Then, the rotational speed of the HST motor 42 increases, and thus the vehicle speed increases. The vehicle speed is detected by a motor rotational speed sensor 72 as the rotational speed of the HST motor 42 (see FIG. 4).

Thus, in the HST travel drive system, the discharge flow rate of the HST pump 41 is continuously increased and decreased to adjust the vehicle speed (shift gears). This ensures the wheel loader 1 to smoothly start moving and stop with less impact. The vehicle speed is not necessarily required to be controlled by adjusting the discharge flow rate on the HST pump 41 side, but the vehicle speed may be controlled by adjusting the displacement volume on the HST motor 42 side.

In this embodiment, a speed stage switch 63 (see FIG. 4) is configured to set a maximum vehicle speed to first to fourth speed stages as illustrated in FIG. 7. As illustrated in FIG. 7, the maximum vehicle speed is set to S1 at the first speed stage, the maximum vehicle speed is set to S2 at the second speed stage, the maximum vehicle speed is set to S3 at the third speed stage, and the maximum vehicle speed is set to S4 at the fourth speed stage. S1, S2, S3, and S4 have a magnitude relationship of S1<S2<S3<S4. FIG. 7 illustrates a relationship between the maximum vehicle speed and the driving force for each speed stage.

Among the first to fourth speed stages, the first speed stage and the second speed stage correspond to a "low speed stage," and the third speed stage and the fourth speed stage correspond to "middle and high speed stages." This "low speed stage" is selected in case that the wheel loader 1 travels toward the dump truck 100B in the loading work (the case indicated by the arrow Y1 in FIG. 2), and the maximum vehicle speed is set to, for example, 9 to 15 km/h.

A traveling direction of the wheel loader 1, that is, a forward movement or a backward movement is selected with a forward/reverse selector switch 62 (see FIG. 4) disposed in the cab 12. Specifically, when the operator turns the forward/reverse selector switch 62 to a forward movement position, a forward/reverse switching signal indicating the forward movement is output to the controller 5, and the controller 5 outputs a command signal to engage a forward clutch of a transmission to the transmission. When the transmission receives the command signal for the forward movement, the forward clutch is engaged and the traveling direction of the vehicle body is turned to the forward movement. Turning to the backward movement of the vehicle body is performed with a similar mechanism.

(Drive System of Front Working Device 2)

Next, the drive system of the front working device 2 will be described with reference to FIG. 4 and FIG. 8.

Figure 8:
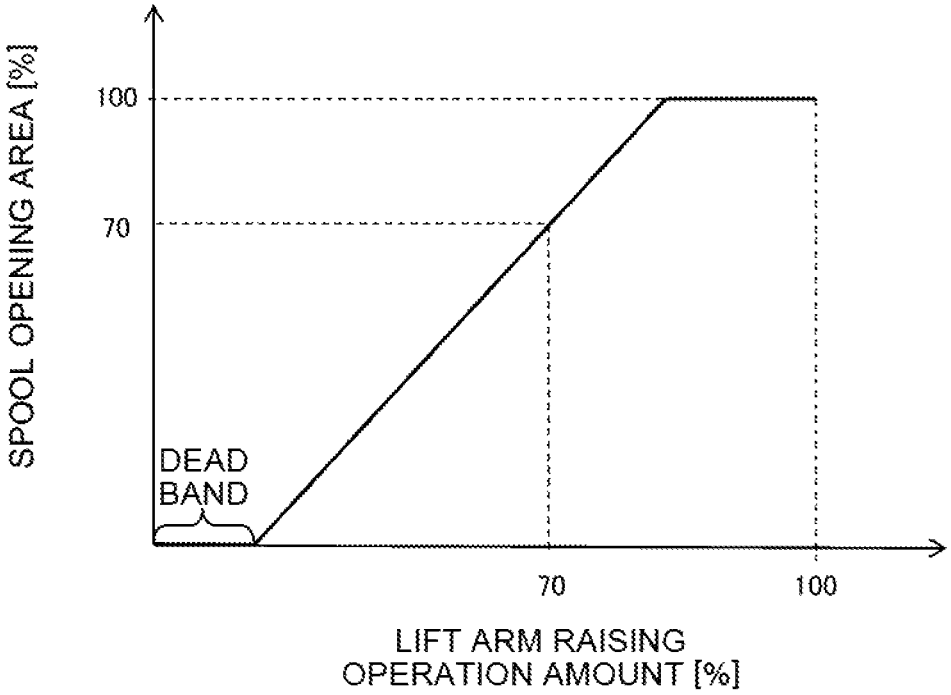
FIG. 8 is a graph illustrating a relation between a raising operation amount of a lift arm and an opening area of a spool.

FIG. 8 is a graph illustrating a relation between a raising operation amount of the lift arm 21 and an opening area of a spool.

As illustrated in FIG. 4, the wheel loader 1 is driven by the engine 3, and includes a hydraulic pump for working device 43, a hydraulic oil tank 44, a lift arm operating lever 210, a bucket operating lever 230, and a control valve 64. The hydraulic pump for working device 43 supplies the hydraulic oil to the front working device 2. The hydraulic oil tank 44 stores this hydraulic oil. The lift arm operating lever 210 is disposed to operate the lift arm 21. The bucket operating lever 230 is disposed to operate the bucket 23. The control valve 64 controls flows of the pressure oils supplied from the hydraulic pump for working device 43 to the respective lift arm cylinder 22 and bucket cylinder 24.

For the hydraulic pump for working device 43, in this embodiment, a fixed-type hydraulic pump is used. The discharge pressure from the hydraulic pump for working device 43 is detected by a pressure sensor 73, and a signal for the detected discharge pressure is output to the controller 5.

When the operator operates the lift arm operating lever 210 in a direction of raising the lift arm 21, a pilot pressure corresponding to the operation amount of the operation is generated. This pilot pressure corresponds to the raising operation amount of the lift arm 21 by the lift arm operating lever 210.

Then, the generated pilot pressure acts on the control valve 64 to cause the spool in the control valve 64 to stroke corresponding to this pilot pressure. The hydraulic oil discharged from the hydraulic pump for working device 43 flows into the lift arm cylinder 22 via the control valve 64, thus extending the rod 220 of the lift arm cylinder 22.

As illustrated in FIG. 8, the opening area [%] of the spool of the control valve 64 is proportional to the raising operation amount [%] of the lift arm 21, and the opening area of the spool increases as the raising operation amount of the lift arm 21 increases. Accordingly, greatly operating the lift arm operating lever 210 in the direction of raising the lift arm 21 increases the amount of the hydraulic oil flowing into the lift arm cylinder 22, thus quickly extending the rod 220.

In FIG. 8, in a range of 0 to 20% of the raising operation amount of the lift arm 21, the spool does not open and the opening area is 0% (dead band). In a range of 85 to 100% of the raising operation amount of the lift arm 21, the opening area of the spool is constant at 100% and a full-lever operation state is kept. These setting ranges are conveniently changeable.

For the operation of the bucket 23, similarly to the operation of the lift arm 21, the pilot pressure generated corresponding to the operation amount of the bucket operating lever 230 acts on the control valve 64 so as to control the opening area of the spool of the control valve 64, thus adjusting the amount of the hydraulic oil flowing into/out of the bucket cylinder 24.

While illustrations are omitted in FIG. 4, operation amount (pilot pressure) sensors for detecting raising and lowering operation amounts of the lift arm 21 and tilting and dumping operation amounts of the bucket 23 are disposed on respective pipe passages of the hydraulic circuit.

(Configuration and Function of Controller 5)

Next, the configuration and function of the controller 5 will be described with reference to FIGS. 9 to 13.

Figure 9:
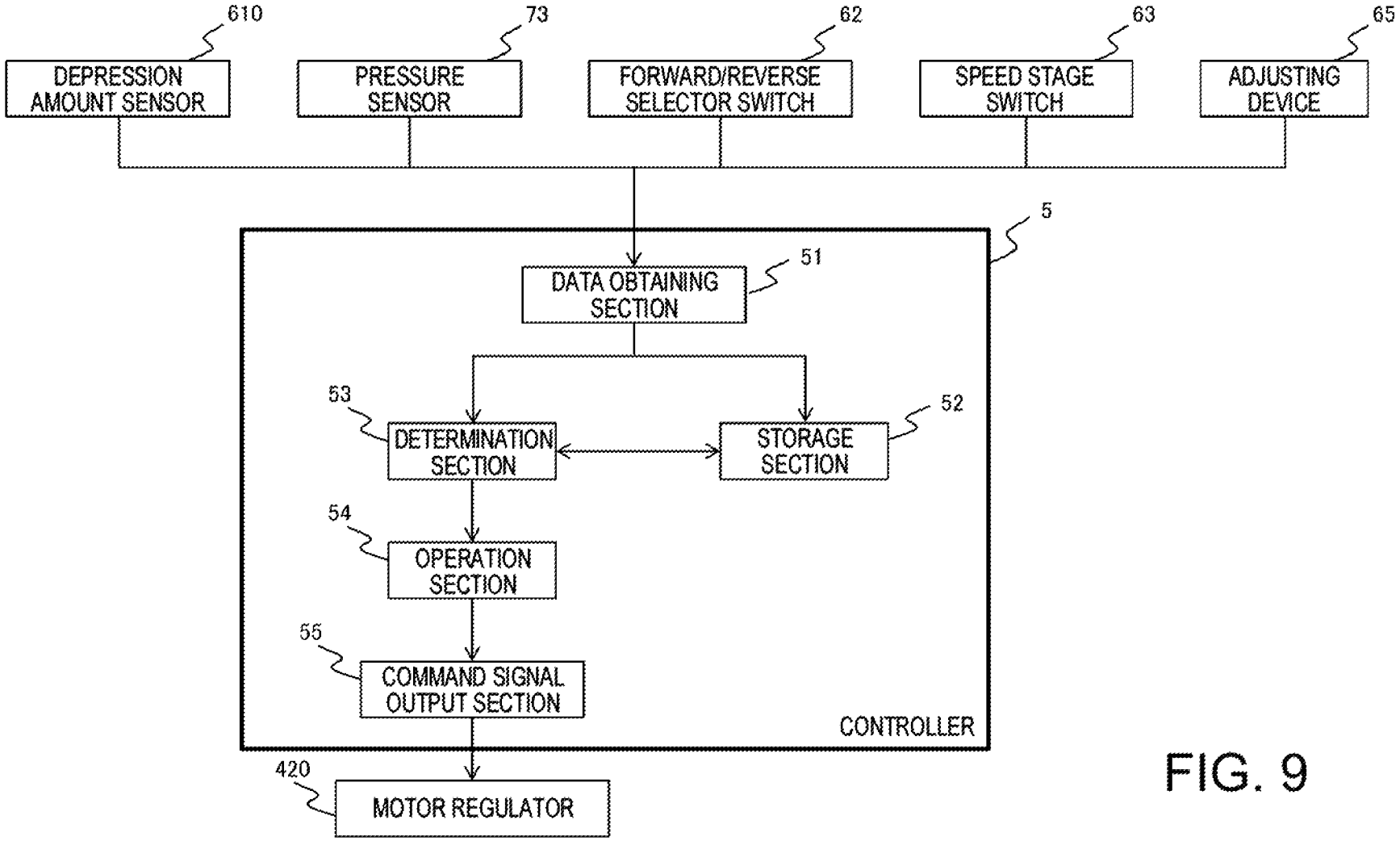
FIG. 9 is a function block diagram illustrating functions included in a controller.
Figure 10:
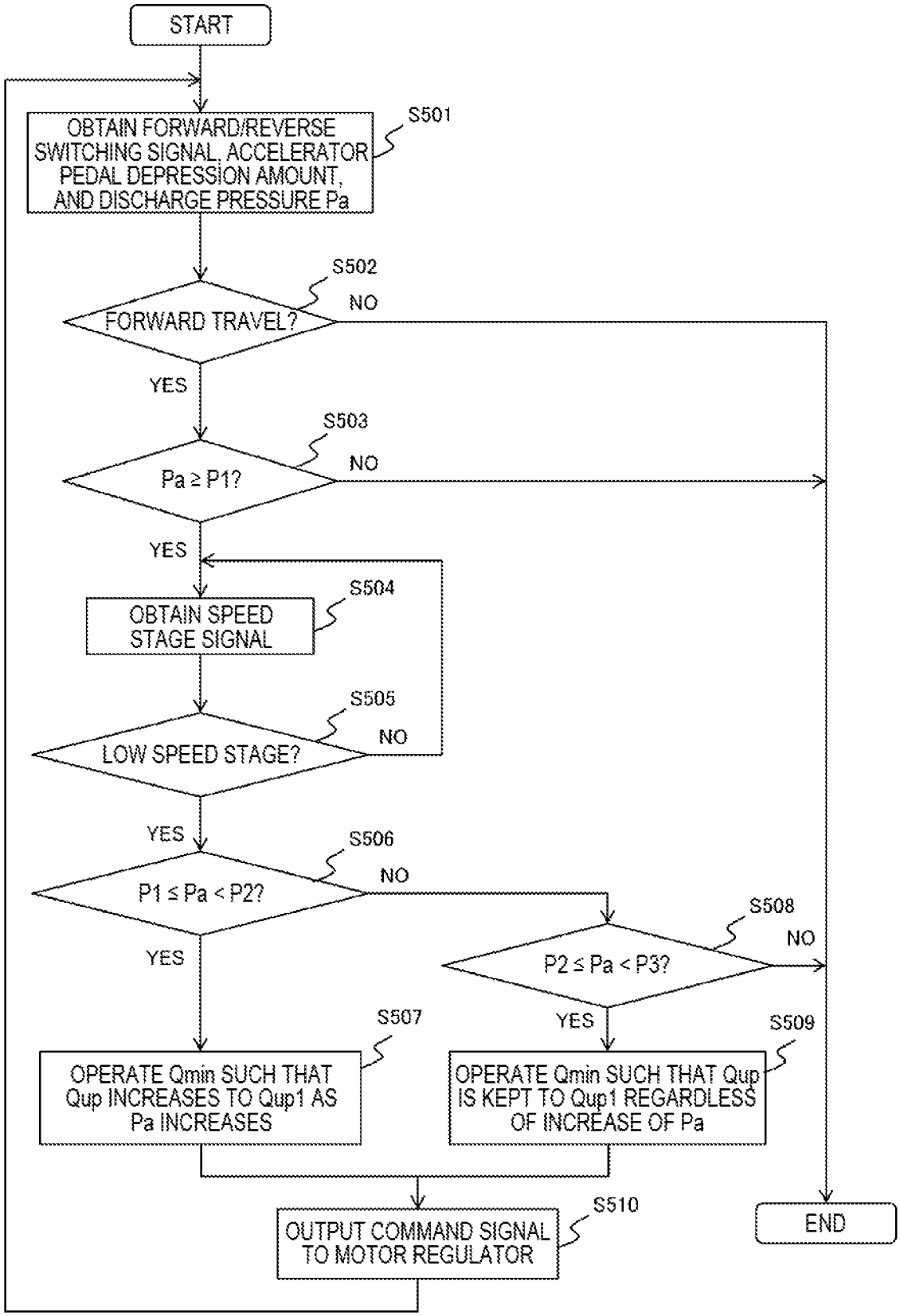
FIG. 10 is a flowchart illustrating a flow of a process executed by the controller.
Figure 11:
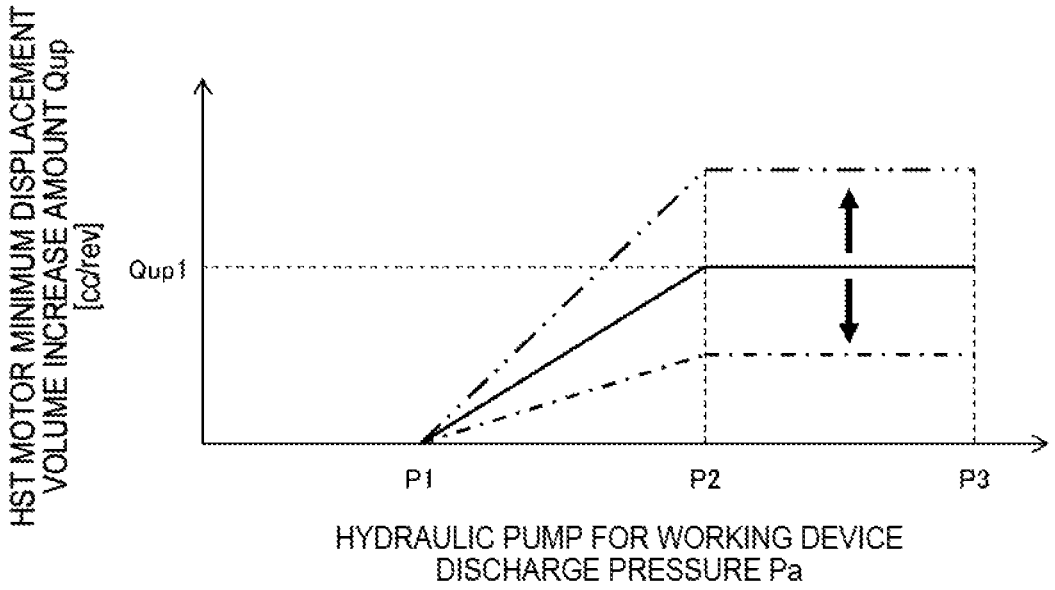
FIG. 11 is a graph illustrating a relation between a discharge pressure of a hydraulic pump for working device and a minimum displacement volume increase amount of an HST motor.
Figure 12:
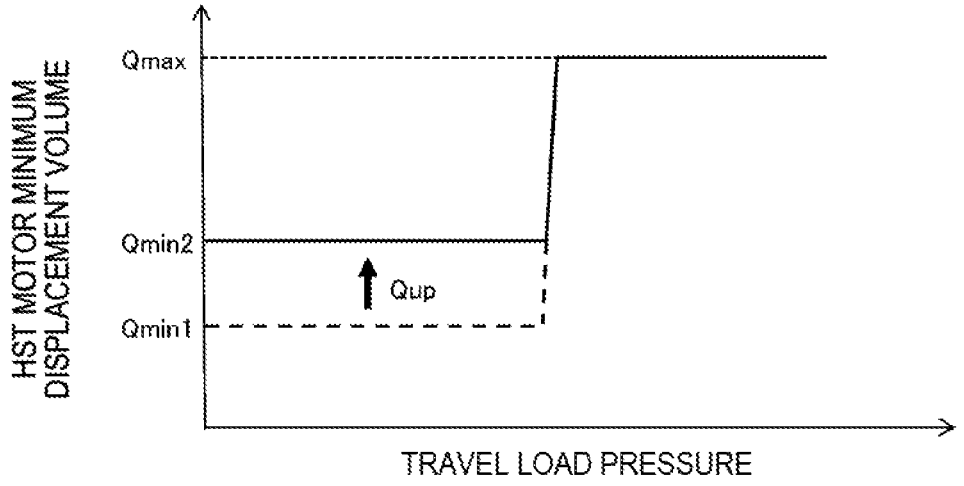
FIG. 12 is a graph illustrating a relation between a travel load pressure and the minimum displacement volume of the HST motor.
Figure 13:
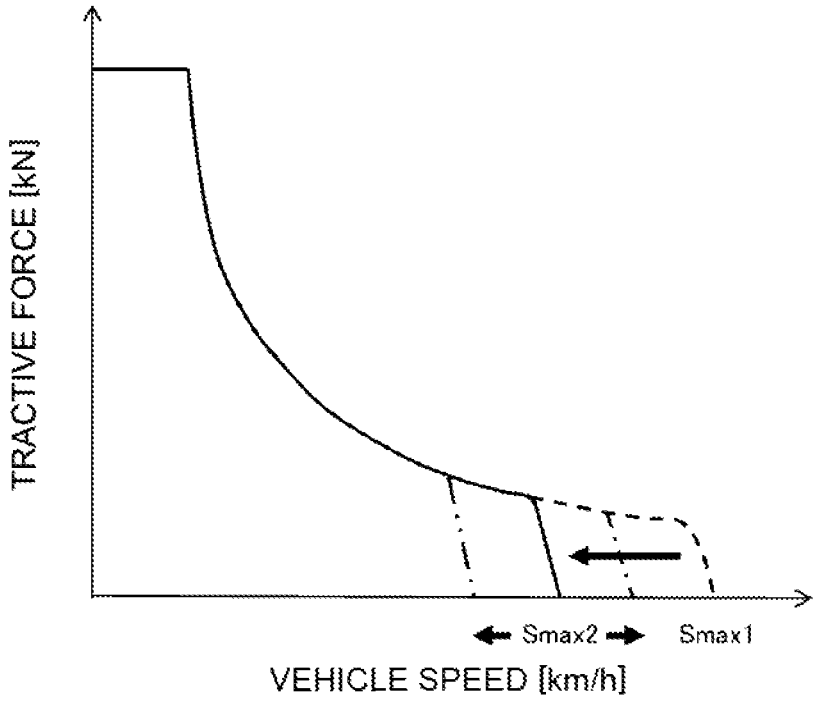
FIG. 13 is a graph illustrating a relation between the vehicle speed and a tractive force of the wheel loader.

FIG. 9 is a function block diagram illustrating the functions included in the controller 5. FIG. 10 is a flowchart illustrating a flow of a process executed by the controller 5. FIG. 11 is a graph illustrating a relation between a discharge pressure Pa of the hydraulic pump for working device 43 and a minimum displacement volume increase amount Qup of the HST motor 42. FIG. 12 is a graph illustrating a relation between a travel load pressure and the minimum displacement volume Qmin of the HST motor 42. FIG. 13 is a graph illustrating a relation between the vehicle speed and a tractive force of the wheel loader 1.

The controller 5 includes a CPU, a RAM, a ROM, a HDD, an input I/F, and an output I/F, which are mutually coupled via a bus. Then, various operation devices such as the forward/reverse selector switch 62 and the speed stage switch 63, and various sensors and the like such as the pressure sensor 73 and the depression amount sensor 610 (see FIG. 4) are coupled to the input I/F. The pump regulator 410 of the HST pump 41, the motor regulator 420 of the HST motor 42, and the like are coupled to the output I/F.

In such a hardware configuration, the CPU reads calculation programs (software) stored in a recording medium such as the ROM, the HDD, or an optical disk, the CPU deploys the calculation programs on the RAM, and the CPU executes the deployed calculation programs, and thus the calculation programs collaborate with the hardware to achieve the functions of the controller 5.

While the configuration of the controller 5 is described as the combination of the software and the hardware in this embodiment, the configuration is not limited to this, and the controller 5 may be configured using an integrated circuit that achieves the functions of the calculation programs executed on the wheel loader 1 side.

As illustrated in FIG. 9, the controller 5 includes a data obtaining section 51, a storage section 52, a determination section 53, an operation section 54, and a command signal output section 55.

The data obtaining section 51 obtains the forward/reverse switching signal of the forward movement or the backward movement, the depression amount of the accelerator pedal 61, a speed stage signal, and data on the discharge pressure Pa of the hydraulic pump for working device 43. The forward/reverse switching signal of the forward movement or the backward movement is output from the forward/reverse selector switch 62. The depression amount of the accelerator pedal 61 is detected by the depression amount sensor 610. The speed stage signal is output from the speed stage switch 63. The data on the discharge pressure Pa of the hydraulic pump for working device 43 is detected by the pressure sensor 73.

The storage section 52 stores a first threshold value P1, a second threshold value P2, and a third threshold value P3 for the pressure (discharge pressure of the hydraulic pump for working device 43) necessary for lifting the bucket 23 containing the cargo by the lift arm 21. The first threshold value P1 is the discharge pressure of the hydraulic pump for working device 43 at a time when the lift arm 21 starts the operation to lift the bucket 23 containing the cargo in the upper direction. The second threshold value P2 is the discharge pressure of the hydraulic pump for working device 43 at a time when this lift arm 21 takes a horizontal posture. The third threshold value P3 is the discharge pressure of the hydraulic pump for working device 43 at a time when this lift arm 21 fully rises in the upper direction, that is, a relief pressure.

The determination section 53 determines whether the wheel loader 1 is during the forward travel or not based on the forward/reverse switching signal and the depression amount of the accelerator pedal 61, which are obtained by the data obtaining section 51, and the determination section 53 determines whether the lift arm 21 is during the raising movement or not based on the discharge pressure Pa of the hydraulic pump for working device 43 obtained by the data obtaining section 51. Hereinafter, a condition to identify the upward movement of the lift arm 21 during the forward travel of the wheel loader 1 is referred to as a "specific condition," and a case where this "specific condition" is satisfied is a case where the above-described rise/run operation is performed.

Here, the forward/reverse selector switch 62 and the depression amount sensor 610 are each one aspect of a travel state sensor that detects a travel state of the vehicle body of the wheel loader 1. In this embodiment, the forward travel of the vehicle body is determined based on the forward/reverse switching signal indicating the forward movement output from the forward/reverse selector switch 62 and the depression amount of the accelerator pedal 61 detected by the depression amount sensor 610. However, the configuration is not limited to this, but the forward travel of the vehicle body may be comprehensively determined based on the respective travel states detected by plurality of other travel state sensors mounted to the vehicle body.

Furthermore, the determination section 53 determines the respective magnitude relationships between the discharge pressure Pa and the first to third threshold values P1, P2, and P3 based on the discharge pressure Pa of the hydraulic pump for working device 43 obtained by the data obtaining section 51 and the first to third threshold values P1, P2, and P3 read from the storage section 52. The determination section 53 also determines whether the low speed stage is selected or not based on the speed stage signal obtained by the data obtaining section 51.

The operation section 54 operates the minimum displacement volume Qmin of the HST motor 42 when the determination section 53 determines that the specific condition is satisfied (during the rise/run operation). The operation section 54 is not necessarily required to operate the minimum displacement volume Qmin of the HST motor 42, and instead, the operation section 54 may operate a maximum displacement volume Qmax of the HST pump 41.

The command signal output section 55 outputs the command signal according to the minimum displacement volume Qmin of the HST motor 42 operated by the operation section 54 to the motor regulator 420. In the case where the operation section 54 operates the maximum displacement volume Qmax of the HST pump 41, the command signal output section 55 outputs the command signal according to the maximum displacement volume Qmax of the HST pump 41 to the pump regulator 410.

Next, a description will be given of a specific flow of the process executed in the controller 5.

As illustrated in FIG. 10, first, the data obtaining section 51 obtains each of the forward/reverse switching signal from the forward/reverse selector switch 62, the depression amount of the accelerator pedal 61 from the depression amount sensor 610, and the discharge pressure Pa of the hydraulic pump for working device 43 from the pressure sensor 73 (Step S501). Subsequently, the determination section 53 determines whether the wheel loader 1 is during the forward travel or not based on the forward/reverse switching signal and the depression amount of the accelerator pedal 61 which are obtained at Step S501 (Step S502).

In the case of the determination of during the forward travel at Step S502 (Step S502/YES), the determination section 53 determines the magnitude relationship between the discharge pressure Pa of the hydraulic pump for working device 43 obtained at Step S501 and the first threshold value P1 read from the storage section 52 (Step S503). That is, at Step S503, whether the lift arm 21 is during the raising movement or not is determined.

When the discharge pressure Pa is determined to be equal to or more than the first threshold value P1 (Pa P1) at Step S503, that is, when the lift arm 21 is determined to be during the raising movement (Step S503/YES), the data obtaining section 51 obtains the speed stage signal from the speed stage switch 63 (Step S504).

Meanwhile, in the case of the determination of not during the forward travel (stopped or during a backward travel) at Step S502 (Step S502/NO), and when the discharge pressure Pa is determined to be smaller than the first threshold value P1 (Pa<P1) at Step S503, that is, the lift arm 21 is determined not to be during the raising movement (Step S503/NO), the process in the controller 5 terminates. This is because the specific condition is not satisfied in these cases. In other words, "the case where the specific condition is satisfied" is a case where YES at least at Step S502 and YES at Step S503.

The determination section 53 determines whether the speed stage is the low speed stage or not based on the speed stage signal obtained at Step S504 (Step S505). When the speed stage is determined to be the low speed stage at Step S505 (Step S505/YES), the magnitude relationships between the discharge pressure Pa obtained at Step S501, and the first threshold value P1 and the second threshold value P2 read from the storage section 52 are determined. Specifically, the determination section 53 determines whether the discharge pressure Pa is equal to or more than the first threshold value P1 and smaller than the second threshold value P2 or not (Step S506).

When the discharge pressure Pa is determined to be equal to or more than the first threshold value P1 and smaller than the second threshold value P2 (P1 Pa<P2) at Step S506 (Step S506/YES), the operation section 54 operates the minimum displacement volume Qmin of the HST motor 42 such that the discharge pressure Pa of the hydraulic pump for working device 43 has a proportional relationship with the minimum displacement volume increase amount Qup of the HST motor 42 (Step S507).

Then, the command signal output section 55 outputs the command signal according to the minimum displacement volume Qmin of the HST motor 42 operated at Step S507 to the motor regulator 420 (Step S510).

As illustrated in FIG. 11, in a period from the start of the raising operation of the lift arm 21 (first threshold value P1) until the lift arm 21 has the horizontal posture (second threshold value P2), the controller 5 increases the minimum displacement volume Qmin of the HST motor 42 to limit the vehicle speed (decelerate) such that the minimum displacement volume increase amount Qup of the HST motor 42 increases to a predetermined value Qup1 (0<Qup1) as the discharge pressure Pa of the hydraulic pump for working device 43 increases.

Meanwhile, when the discharge pressure Pa is not determined to be equal to or more than the first threshold value P1 and smaller than the second threshold value P2 (P1 Pa<P2) at Step S506 (Step S506/NO), the determination section 53 further determines whether the discharge pressure Pa is equal to or more than the second threshold value P2 and smaller than the third threshold value P3 or not (Step S508).

When the discharge pressure Pa is determined to be equal to or more than the second threshold value P2 and smaller than the third threshold value P3 (P2 Pa<P3) at Step S508 (Step S508/YES), the operation section 54 operates the minimum displacement volume Qmin of the HST motor 42 such that the minimum displacement volume increase amount Qup of the HST motor 42 is kept to the predetermined value Qup1 regardless of the increase of the discharge pressure Pa (Step S509).

Then, the command signal output section 55 outputs the command signal according to the minimum displacement volume Qmin of the HST motor 42 operated at Step S509 to the motor regulator 420 (Step S510).

As illustrated in FIG. 11, in a period from when the lift arm 21 has the horizontal posture (second threshold value P2) until the lift arm 21 fully rises upward (third threshold value P3), the controller 5 increases the minimum displacement volume Qmin of the HST motor 42 to limit the vehicle speed (decelerate) such that the minimum displacement volume increase amount Qup of the HST motor 42 is kept to the predetermined value Qup1 regardless of the increase of the discharge pressure Pa of the hydraulic pump for working device 43.

As described above, when the controller 5 determines that the specific condition is satisfied (during the rise/run operation) (at least Step S502/YES and Step S503/YES), increasing the minimum displacement volume Qmin of the HST motor 42 from Qmin1 to Qmin2 (Qmin1→Qmin2, Qmin2>Qmin1) as illustrated in FIG. 12 limits the vehicle speed of the wheel loader 1 from Smax1 to Smax2 (Smax1→Smax2, Smax2<Smax1) as illustrated in FIG. 13.

Accordingly, when the specific condition is satisfied, that is, during the rise/run operation, by limiting the vehicle speed corresponding to the speed of the raising movement of the lift arm 21, a travel distance from the wheel loader 1 to the dump truck 100B (a distance from the wheel loader 1 illustrated by the solid lines to the wheel loader 1 illustrated by the dashed lines in FIG. 2) can be shortened compared with the case where the vehicle speed is not limited.

This is because, when the vehicle speed is not limited corresponding to the speed of the raising movement of the lift arm 21, the wheel loader 1 possibly arrives at the near side of the dump truck 100B before the lift arm 21 fully rises upward, and in this case, the travel distance needs to be lengthened. However, by limiting the vehicle speed (decelerating) corresponding to the speed of the raising movement of the lift arm 21 by the controller 5, the lift arm 21 fully rises even with the short travel distance. This shortens a cycle time of the work in the V-shape loading to enhance the work efficiency and improve the fuel efficiency of the wheel loader 1.

At the determination of whether the specific condition is satisfied or not, the discharge pressure Pa of the hydraulic pump for working device 43 detected by the pressure sensor 73 is used to determine the presence/absence of the raising operation of the lift arm 21. Accordingly, an erroneous determination of the raising operation of the lift arm 21 can be reduced compared with the case of detecting the bottom pressure of the lift arm cylinder 22, thus reducing a sudden change in the vehicle speed. This is because, when the discharge pressure Pa of the hydraulic pump for working device 43 is used, an influence of a pressure variation due to, for example, vibration of the load in the bucket 23 and the vehicle body is small unlike the case where the bottom pressure of the lift arm cylinder 22 is used.

Furthermore, in this embodiment, in a first half of the rise/run operation, that is, in a period from the start of the raising operation of the lift arm 21 until the lift arm 21 has the horizontal posture, the minimum displacement volume increase amount Qup of the HST motor 42 gradually increases as the discharge pressure Pa of the hydraulic pump for working device 43 increases. Accordingly, the vehicle speed is smoothly limited, thus ensuring reduction of vibration and impacts to the vehicle body and the operator due to the sudden deceleration.

When the discharge pressure Pa is not determined to be equal to or more than the second threshold value P2 and smaller than the third threshold value P3 (P2≤Pa<P3) at Step S508 (Step S508/NO), that is, when the discharge pressure Pa becomes the third threshold value P3 (Pa=P3) and the rise/run operation terminates, the process in the controller 5 terminates.

After the command signal output section 55 outputs the command signal to the motor regulator 420 at Step S510, the process returns to Step S501 and is repeated.

In this embodiment, when the speed stage is not the low speed stage at Step S504 (Step S505/NO), the process is configured to return to Step S504 and not to proceed to the process where the minimum displacement volume Qmin of the HST motor 42 is controlled to limit the vehicle speed (process of Step S506 and following processes) until the speed stage becomes the low speed stage. This is because the low speed stage (especially, the second speed stage in FIG. 7) is appropriate for performing the rise/run operation, and it is preferable to limit the vehicle speed only when the low speed stage is selected.

The controller 5 may skip Step S504 and Step S505 and control the minimum displacement volume Qmin of the HST motor 42 regardless of which speed stage is selected.

In this embodiment, the wheel loader 1 includes an adjusting device 65 as illustrated in FIG. 9. This adjusting device 65 is a device with which the operator conveniently adjusts a changing rate of the minimum displacement volume Qmin of the HST motor 42 relative to the discharge pressure Pa of the hydraulic pump for working device 43. The controller 5 stores the changing rate preliminarily set by the adjusting device 65 in the storage section 52, and the operation section 54 operates the minimum displacement volume Qmin of the HST motor 42 according to the stored changing rate.

For example, when the vehicle speed limitation is not so much desired, as indicated by one-dot chain lines in FIG. 11 and FIG. 13, the changing rate of the minimum displacement volume increase amount Qup of the HST motor 42 relative to the discharge pressure Pa of the hydraulic pump for working device 43 is set so as to be decreased with the adjusting device 65. Meanwhile, when the vehicle speed is desired to be significantly limited, as indicated by two-dot chain lines in FIG. 11 and FIG. 13, the changing rate of the minimum displacement volume increase amount Qup of the HST motor 42 relative to the discharge pressure Pa of the hydraulic pump for working device 43 is set so as to be increased with the adjusting device 65.

Then, the adjusting device 65 disposed in the wheel loader 1 ensures the convenient adjustment of the vehicle speed limitation in accordance with, for example, a preference of the operator and an environment of a site, thus improving the convenience.

While the vehicle speed is limited by increasing the minimum displacement volume Qmin of the HST motor 42 in this embodiment, the configuration is not limited to this, and the vehicle speed may be limited by decreasing the maximum displacement volume Qmax of the HST pump 41.

In this case, at Step S507 illustrated in FIG. 10, the operation section 54 operates the maximum displacement volume Qmax of the HST pump 41 such that a maximum displacement volume decrease amount Qdown of the HST pump 41 increases from 0 to a predetermined value Qdown1 (0<Qdown1) as the discharge pressure Pa of the hydraulic pump for working device 43 increases. At Step S509, the operation section 54 operates the maximum displacement volume Qmax of the HST pump 41 such that the maximum displacement volume decrease amount Qdown of the HST pump 41 is kept to a predetermined value Qdown1 regardless of the increase of the discharge pressure Pa of the hydraulic pump for working device 43.

Modification

Figure 14:
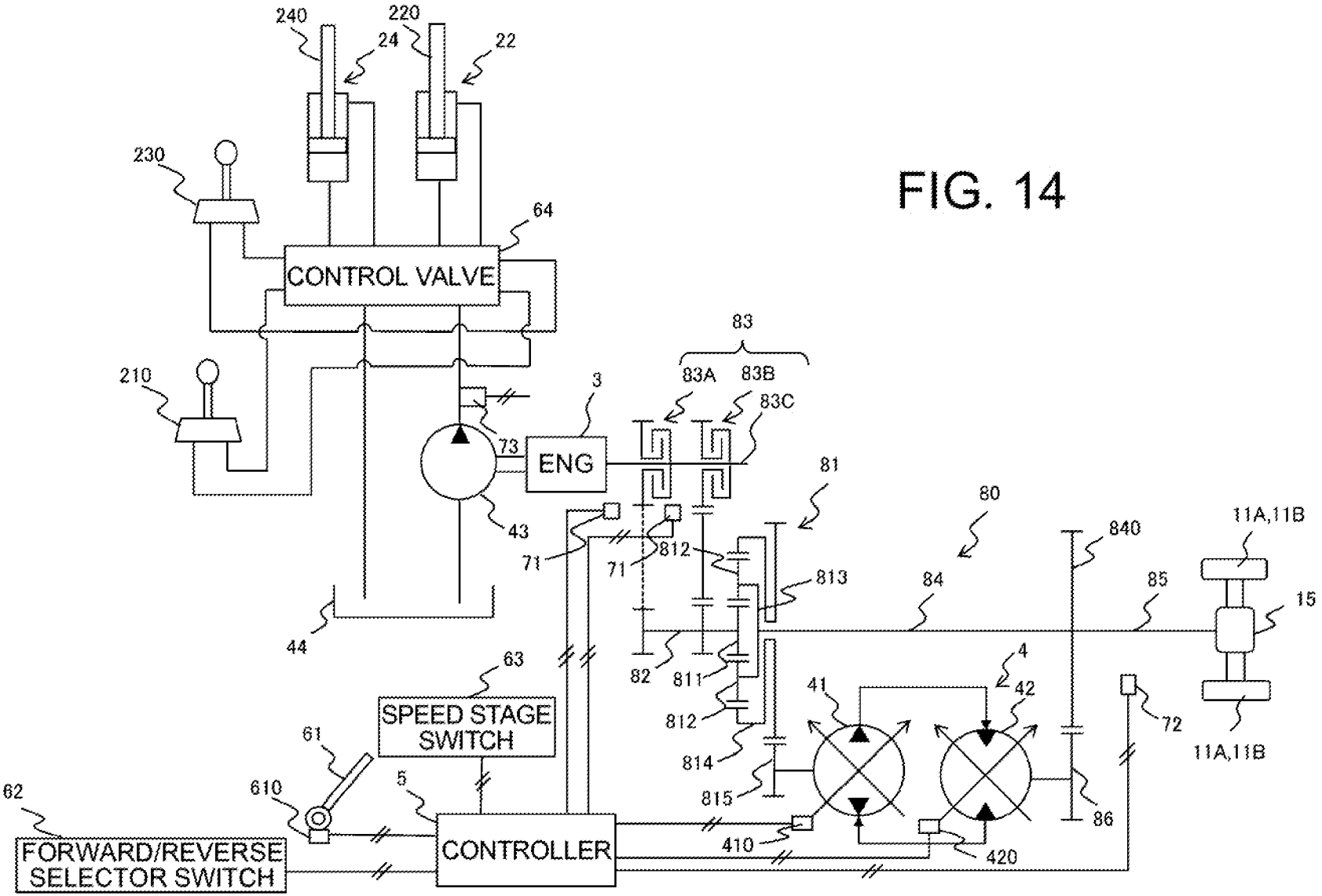
FIG. 14 is a drawing illustrating a hydraulic circuit and an electric circuit of a wheel loader according to a modification.

Next, the modification will be described with reference to FIG. 14. In FIG. 14, like reference numerals designate identical elements described with the wheel loader 1 according to the first embodiment, and the explanations will be omitted.

FIG. 14 is a drawing illustrating a hydraulic circuit and an electric circuit of a wheel loader 1 according to the modification.

In the wheel loader 1 according to this modification, travel of the vehicle body is controlled by an HMT travel drive system. This HMT travel drive system includes an HST 4, in which an HST pump 41 is coupled to an HST motor 42 in a closed circuit, and a mechanical transmission section 80. A driving force of the engine 3 is transmitted to the HST 4 and the mechanical transmission section 80 in parallel via a planetary gear mechanism 81.

The planetary gear mechanism 81 includes a sun gear 811, a plurality of planetary gears 812, a planetary carrier 813, a ring gear 814, and a pump input gear 815. The sun gear 811 is secured to an input shaft 82. The plurality of planetary gears 812 mesh with an outer periphery of the sun gear 811. The planetary carrier 813 pivotally supports each of the plurality of planetary gears 812. The ring gear 814 meshes with an outer periphery of the plurality of planetary gears 812. The pump input gear 815 meshes with an outer periphery of the ring gear 814.

An output torque of the engine 3 is transmitted to the input shaft 82 via a clutch device 83, which includes a forward hydraulic clutch 83A, a backward hydraulic clutch 83B, and a clutch shaft 83C, and the output torque is transmitted from the input shaft 82 to the planetary gear mechanism 81.

Here, the planetary carrier 813 of the planetary gear mechanism 81 is secured to an output shaft 84 such that the driving force of the engine 3 is transmitted to the mechanical transmission section 80. The driving force of the engine 3 transmitted to the mechanical transmission section 80 is transmitted to an axle 15 via a propeller shaft 85, which is coupled to the output shaft 84, so as to drive the front wheels 11A and the rear wheels 11B.

The pump input gear 815 of the planetary gear mechanism 81 is secured to a rotation shaft of the HST pump 41 such that the driving force of the engine 3 is also transmitted to the HST 4. A motor output gear 86 is secured to the rotation shaft of the HST motor 42, and the motor output gear 86 meshes with a gear 840 of the output shaft 84. Accordingly, the driving force of the engine 3 transmitted to the HST 4 is also transmitted to the axle 15 via the propeller shaft 85 coupled to the output shaft 84, so as to drive the front wheels 11A and the rear wheels 11B.

Thus, the configuration of the transmission having the combination of the HST 4 and the mechanical transmission section 80 ensures enhanced transmission efficiency compared with the HST travel drive system described in the first embodiment. Note that, while FIG. 14 illustrates the HMT travel drive system of an input-split type where the output from the planetary gear mechanism 81 is input to the HST 4, the configuration is not limited to this, and an HMT travel drive system of an output-split type where the output from the HST 4 is input to the planetary gear mechanism 81 may be employed.

Also in this modification, similarly to the first embodiment, the controller 5 increases the minimum displacement volume Qmin of the HST motor 42 according to the increase of the discharge pressure Pa of the hydraulic pump for working device 43 when the specific condition is satisfied, thus limiting the vehicle speed. This ensures the operation and effect similar to the operation and effect described in the first embodiment.

Second Embodiment

Figure 15:
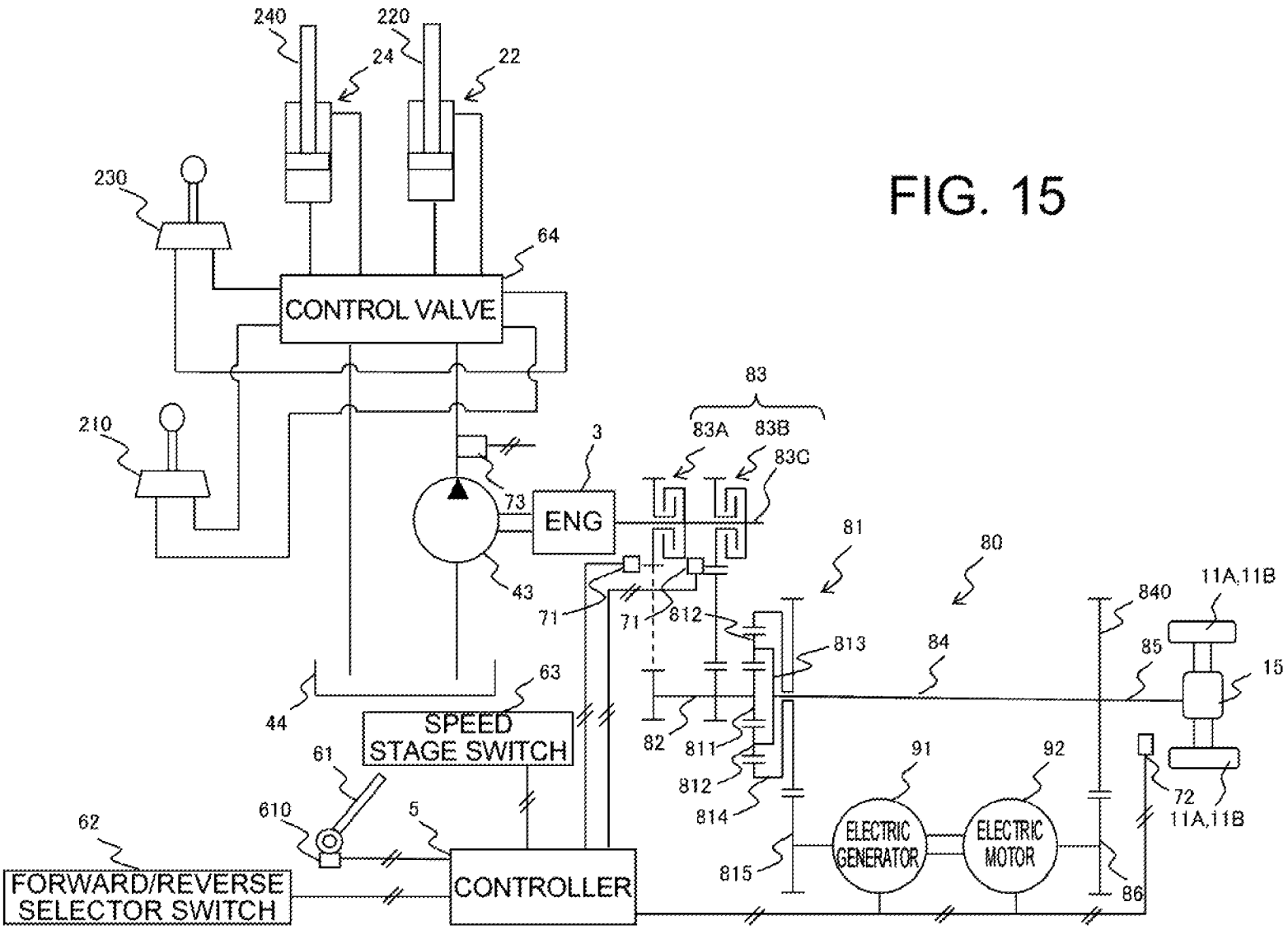
FIG. 15 is a drawing illustrating a hydraulic circuit and an electric circuit of a wheel loader according to a second embodiment.

Next, a wheel loader 1 according to the second embodiment will be described with reference to FIG. 15. In FIG. 15, like reference numerals designate identical elements described with the wheel loader 1 according to the first embodiment and the modification, and the explanations will be omitted.

FIG. 15 is a drawing illustrating a hydraulic circuit and an electric circuit of the wheel loader 1 according to the second embodiment.

In the wheel loader 1 according to the embodiment, travel of the vehicle body is controlled by an EMT travel drive system. This EMT travel drive system includes an electric generator 91 and an electric motor 92 instead of the HST pump 41 and the HST motor 42, respectively, in the above-described HMT travel drive system.

In this embodiment, when the specific condition is satisfied, the controller 5 decreases a rotational speed of the electric motor 92 according to the increase of the discharge pressure Pa of the hydraulic pump for working device 43, thus limiting the vehicle speed. The rotational speed of the electric motor 92 is controlled by changing a current value or a voltage value to the electric motor 92.

Specifically, at Step 507 illustrated in FIG. 10, the operation section 54 operates the current value or the voltage value to the electric motor 92 such that a decrease amount of the rotational speed of the electric motor 92 increases to a predetermined value as the discharge pressure Pa of the hydraulic pump for working device 43 increases. At Step S509 illustrated in FIG. 10, the operation section 54 operates the current value or the voltage value to the electric motor 92 such that the decrease amount of the rotational speed of the electric motor 92 is kept to this predetermined value regardless of the increase of the discharge pressure Pa of the hydraulic pump for working device 43.

That is, the controller 5 limits the rotational speed of the electric motor 92 such that the relationship illustrated in FIG. 11 is established between the discharge pressure Pa of the hydraulic pump for working device 43 and the decrease amount of the rotational speed of the electric motor 92. This ensures the operation and effect similar to the operation and effect described in the first embodiment.

The embodiments and modification of the present invention have been described above. The present invention is not limited to the above-described embodiments and modification, but includes various other modifications. For example, the above-described embodiments and modification have been described in detail in order to easily describe the present invention, and therefore, it is not necessarily limited to include all the described configurations. It is possible to replace a part of the configuration of the embodiment with a configuration of another embodiment, and it is possible to add a configuration of another embodiment to the configuration of this embodiment. Furthermore, a part of the configuration of the embodiment can be subjected to an addition, a removal, and a replacement of another configuration.

For example, in the above-described embodiments and modification, the controller 5 limits the vehicle speed according to the increase of the discharge pressure Pa of the hydraulic pump for working device 43 when the specific condition is satisfied. However, the configuration is not limited to this, and the vehicle speed may be limited according to the increase of the input torque of the hydraulic pump for working device 43.

In the above-described embodiments and modification, the controller 5 limits the vehicle speed based on the discharge pressure Pa of the hydraulic pump for working device 43 (input torque of the hydraulic pump for working device 43) detected by the pressure sensor 73. However, the configuration is not limited to this, and the vehicle speed may be limited based on an average discharge pressure Pav (average input torque) in a predetermined set period. In this case, use of the average value ensures the stable vehicle speed limitation even if the detected value varies due to, for example, occurrence of instantaneous large vibration and collision of the vehicle body.

LIST OF REFERENCE SIGNS

1: wheel loader
2: front working device
3: engine
5: controller
11A: front wheel
11B: rear wheel
21: lift arm
41: HST pump (travel hydraulic pump)
42: HST motor (travel hydraulic motor)
43: hydraulic pump for working device
65: adjusting device
73: pressure sensor
91: electric generator
92: electric motor
100B: dump truck

The invention claimed is:

1. A wheel loader that includes a front working device, the front working device including a lift arm disposed on a front portion of a vehicle body, the lift arm being turnable in a vertical direction, the wheel loader comprising:

an engine;

a variable displacement type travel hydraulic pump driven by the engine;

a variable displacement type travel hydraulic motor coupled to the travel hydraulic pump in a closed circuit, the travel hydraulic motor transmitting a driving force of the engine to wheels;

a hydraulic pump for working device driven by the engine, the hydraulic pump for working device supplying a hydraulic oil to the front working device;

a travel state sensor that detects a travel state of the vehicle body;

a pressure sensor that detects a discharge pressure of the hydraulic pump for working device; and a controller that controls the travel hydraulic pump and the travel hydraulic motor, wherein the controller:

determines whether a specific condition is satisfied based on the travel state detected by the travel state sensor and the discharge pressure detected by the pressure sensor, the specific condition is a condition to identify an upward movement of the lift arm during a forward travel of the vehicle body, and controls a displacement volume of the travel hydraulic pump or a displacement volume of the travel hydraulic motor according to an increase of the discharge pressure of the hydraulic pump for working device or an increase of an input torque of the hydraulic pump for working device when the specific condition is satisfied, so as to limit a vehicle speed.

2. The wheel loader according to claim 1, wherein the controller increases a minimum displacement volume of the travel hydraulic motor as the discharge pressure of the hydraulic pump for working device or the input torque of the hydraulic pump for working device increases, so as to limit the vehicle speed.

3. The wheel loader according to claim 2, wherein the controller:

controls the travel hydraulic motor such that, in a period from a start of a raising operation of the lift arm until the lift arm takes a horizontal posture, a minimum displacement volume increase amount of the travel hydraulic motor increases to a predetermined value as the discharge pressure of the hydraulic pump for working device or the input torque of the hydraulic pump for working device increases, and controls the travel hydraulic motor such that, in a period from when the lift arm has the horizontal posture until the lift arm fully rises upward, the minimum displacement volume increase amount of the travel hydraulic motor is kept to the predetermined value regardless of the increase of the discharge pressure of the hydraulic pump for working device or the increase of the input torque of the hydraulic pump for working device.

4. The wheel loader according to claim 1, wherein the controller decreases a maximum displacement volume of the travel hydraulic pump as the discharge pressure of the hydraulic pump for working device or the input torque of the hydraulic pump for working device increases, so as to limit the vehicle speed.

5. The wheel loader according to claim 4, wherein the controller:

controls the travel hydraulic pump such that, in a period from a start of a raising operation of the lift arm until the lift arm takes a horizontal posture, a maximum displacement volume decrease amount of the travel hydraulic pump increases to a predetermined value as the discharge pressure of the hydraulic pump for working device or the input torque of the hydraulic pump for working device increases, and controls the travel hydraulic pump such that, in a period from when the lift arm has the horizontal posture until the lift arm fully rises upward, the maximum displacement volume decrease amount of the travel hydraulic pump is kept to the predetermined value regardless of the increase of the discharge pressure of the hydraulic pump for working device or the increase of the input torque of the hydraulic pump for working device.

6. The wheel loader according to claim 1, wherein the controller controls the displacement volume of the travel hydraulic pump or the displacement volume of the travel hydraulic motor to limit the vehicle speed only in case that a speed stage of the wheel loader is a low speed stage which is selected at a travel toward a dump truck in a loading work.

7. The wheel loader according to claim 1, further comprising an adjusting device that adjusts a changing rate of the displacement volume of the travel hydraulic pump or a changing rate of the displacement volume of the travel hydraulic motor relative to the discharge pressure of the hydraulic pump for working device or the input torque of the hydraulic pump for working device, wherein the controller controls the displacement volume of the travel hydraulic pump or the displacement volume of the travel hydraulic motor in accordance with the changing rate set by the adjusting device, so as to limit the vehicle speed.

8. A wheel loader that includes a front working device, the front working device including a lift arm disposed on a front portion of a vehicle body, the lift arm being turnable in a vertical direction, the wheel loader comprising:

an engine;

an electric generator driven by the engine;

an electric motor coupled to the electric generator, the electric motor transmitting a driving force of the engine to a wheel;

a hydraulic pump for working device driven by the engine, the hydraulic pump for working device supplying a pressure oil to the front working device;

a travel state sensor that detects a travel state of the vehicle body;

a pressure sensor that detects a discharge pressure of the hydraulic pump for working device; and a controller that controls the electric motor, wherein the controller:

determines whether a specific condition is satisfied based on the travel state detected by the travel state sensor and the discharge pressure detected by the pressure sensor, the specific condition is a condition to identify an upward movement of the lift arm during a forward travel of the vehicle body, and decreases a rotational speed of the electric motor as the discharge pressure of the hydraulic pump for working device or an input torque of the hydraulic pump for working device increases when the specific condition is satisfied, so as to limit a vehicle speed.

* * * * *